US011134813B2

(12) United States Patent
Ma

(10) Patent No.: US 11,134,813 B2
(45) Date of Patent: Oct. 5, 2021

(54) 2-IN-1 NAIL LAMP STATION

(71) Applicant: Carol Ma, Hacienda Heights, CA (US)

(72) Inventor: Carol Ma, Hacienda Heights, CA (US)

(73) Assignee: APPLIED LACQUER INDUSTRIES INC., City of Industry, CA (US)

( * ) Notice: Subject to any disclaimer, the term of this patent is extended or adjusted under 35 U.S.C. 154(b) by 17 days.

(21) Appl. No.: 16/361,215

(22) Filed: Mar. 22, 2019

(65) Prior Publication Data

US 2020/0297171 A1 Sep. 24, 2020

(51) Int. Cl.

| | |
|---|---|
| ***F26B 3/34*** | (2006.01) |
| ***A47K 10/48*** | (2006.01) |
| ***A45D 29/18*** | (2006.01) |
| *A45D 29/05* | (2006.01) |
| *A45D 29/14* | (2006.01) |

(52) U.S. Cl.

CPC ..... *A47K 10/48* (2013.01); *A45D 29/18* (2013.01); *A45D 29/05* (2013.01); *A45D 29/14* (2013.01); *A45D 2200/10* (2013.01); *A45D 2200/155* (2013.01); *A45D 2200/25* (2013.01)

(58) Field of Classification Search

CPC ..... A47K 10/48; A45D 29/04; A45D 29/18; A45D 29/05; A45D 29/14; A45D 2200/155; A45D 2200/10; A45D 2200/25

USPC ..... 34/278, 279, 202

See application file for complete search history.

(56) References Cited

U.S. PATENT DOCUMENTS

| | | | | | |
|---|---|---|---|---|---|
| 5,395,166 | A * | 3/1995 | Watson | A45D 29/18 | 312/244 |
| 6,394,575 | B1 * | 5/2002 | Kent | B05B 12/1418 | 347/2 |
| 10,247,475 | B2 * | 4/2019 | Valia | A45D 29/22 | |
| 2004/0065336 | A1 * | 4/2004 | Fung | A45D 44/02 | 132/73.5 |
| 2009/0185367 | A1 * | 7/2009 | Moore | F21L 4/027 | 362/158 |
| 2012/0057253 | A1 * | 3/2012 | Takagi | G02B 27/0172 | 359/861 |
| 2013/0021395 | A1 * | 1/2013 | Bitoh | A45D 29/00 | 347/2 |
| 2013/0161531 | A1 * | 6/2013 | Haile | A45D 29/00 | 250/455.11 |
| 2013/0298926 | A1 * | 11/2013 | Smeragliuolo | A45D 29/20 | 132/75 |
| 2015/0378455 | A1 * | 12/2015 | Immel | G06F 3/0383 | 345/179 |
| 2016/0166041 | A1 * | 6/2016 | Duru | A45D 29/18 | 250/453.11 |

(Continued)

*Primary Examiner* — John P McCormack

(74) *Attorney, Agent, or Firm* — Pillsbury Winthrop Shaw Pittman LLP

(57) ABSTRACT

A nail lamp station includes a base lamp assembly and a handheld nail care tool for providing an additional nail care function. The base lamp assembly includes a station housing having a light cavity capable of receiving multiple fingernails therewithin, and a main light source supported within the light cavity for drying nail polishes on the fingernails at the same time within the light cavity. The handheld nail care tool includes a detachable lamp pen detachably coupled at the station housing, wherein the detachable lamp pen includes an elongated pen body and a point light source provided at a light end of the pen body for drying the nail polish on one single particular fingernail.

29 Claims, 5 Drawing Sheets

(56) References Cited

U.S. PATENT DOCUMENTS

| | | | | |
|---|---|---|---|---|
| 2017/0225184 | A1* | 8/2017 | Lee | B05B 7/2435 |
| 2017/0354235 | A1* | 12/2017 | Miller | A46B 15/00 |
| 2019/0150585 | A1* | 5/2019 | Ayukawa | A45D 29/18 |
| 2020/0008554 | A1* | 1/2020 | Ko | F21V 33/008 |
| 2020/0128935 | A1* | 4/2020 | Turner | A45D 20/10 |
| 2020/0280680 | A1* | 9/2020 | Nichols | A46B 9/021 |

* cited by examiner

2-IN-1 NAIL LAMP STATION

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a nail lamp, and more particularly to a 2-in-1 nail lamp station, which comprises a base lamp assembly for drying nail polishes on multiple nail surfaces, and a detachable lamp pen for drying the nail polish on a particular nail surface.

Description of Related Arts

Various methods have been devised to alleviate the burden on individuals applying nail polish to their fingernail or toenails. Particularly, a plurality of nail coatings are orderly applied on the nail surface. For example, a base coat, one or more nail polishing coats, and a protection coat are orderly applied on the nail surface. A nail accessory or decoration, such as jewel or sticker, can be glued on the nail surface before the protection coat is on the nail surface.

It is worth mentioning that all the nail coatings must be dried individually. In particular, in order to dry each nail coating on the nail surface, the nail surface must be exposed under a LED light or a UV light. A conventional nail lamp generally comprises a light source supported within a light cavity, wherein multiple nail surfaces can be placed under the light source within the light cavity to dry the nail coatings on the nail surfaces at the same time. In other words, the conventional nail lamp provides a relatively large area for the user to conveniently dry the nail coatings on the nail surfaces, such as drying the base coats on the nail surfaces at the same time. However, the conventional nail lamp has several drawbacks. Since the conventional nail lamp provides the large drying area, the light intensity may not be evenly distributed within the light cavity, such that the nail coatings may not be dried evenly. Especially when different nail polishing coatings are applied on different nail surfaces, the nail polishing coatings will be dried unevenly due to the coating thickness differences and the uneven light distribution. Furthermore, it is difficult for the user to pin-point a particular coating area on the nail surface needed to be dried. For example, when a nail jewel is glued on the nail surface, a peripheral edge of the nail jewel must be dried to retain the nail jewel on the nail surface. Likewise, after the protection coat is applied on the nail jewel, the conventional nail lamp cannot effectively dry the nail coating with the irregular contour of the nail jewel.

SUMMARY OF THE PRESENT INVENTION

The invention is advantageous in that it provides a 2-in-1 nail lamp station, which comprises a base lamp assembly for drying nail polishes on multiple nail surfaces, and a handheld nail care tool for providing an additional nail care function.

Another advantage of the invention is to provide a 2-in-1 nail lamp station, wherein the handheld nail care tool can be a detachable lamp pen for drying the nail polish on a particular nail surface.

Another advantage of the invention is to provide a 2-in-1 nail lamp station, wherein the handheld nail care tool can be an electric nail file for nail surface treatment.

Another advantage of the invention is to provide a 2-in-1 nail lamp station, wherein the handheld nail care tool, such as the detachable lamp pen or the electric nail file, is automatically charged when it is coupled at the base lamp assembly and is operated in a cable free manner when it is detached from the base lamp assembly.

Another advantage of the invention is to provide a 2-in-1 nail lamp station, wherein the handheld nail care tool is magnetically coupled at the base lamp assembly to automatically align the handheld nail care tool for being stored and charged.

Another advantage of the invention is to provide a 2-in-1 nail lamp station, wherein a light source of the detachable lamp pen is a single light point for generating a focused light to pin-point a drying area on the nail surface.

Another advantage of the invention is to provide a 2-in-1 nail lamp station, wherein the operation of the detachable lamp pen is easy by simply pointing the light end of the detachable lamp pen toward the nail surface.

Another advantage of the invention is to provide a 2-in-1 nail lamp station, which does not involve complicated and expensive mechanical components and processes so that the manufacturing cost of the present invention can be minimized.

Another advantage of the invention is to provide a 2-in-1 nail lamp station, wherein no expensive or complicated structure is required to employ in the present invention in order to achieve the above mentioned objects. Therefore, the present invention successfully provides an economic and efficient solution for two different nail care configuration for nail surface treatment. For example, the present invention provides two different lamp configurations, including the base light station and the detachable light pen, for drying the nail polish on the nail surface. Likewise, the present invention provides two different nail care configurations, including the base light station and the electric nail file, for different nail surface treatments.

Additional advantages and features of the invention will become apparent from the description which follows, and may be realized by means of the instrumentalities and combinations particular point out in the appended claims.

According to the present invention, the foregoing and other objects and advantages are attained by a nail lamp station, comprising:

a base lamp assembly which comprises a station housing having a light cavity capable of receiving multiple fingernails therewithin, and a main light source supported within the light cavity for drying nail polishes on the fingernails at the same time within the light cavity; and a handheld nail care tool detachably coupled at the station housing for providing an additional nail care function.

In one embodiment, the handheld nail care tool can be a detachable lamp pen detachably coupled at the station housing, wherein the detachable lamp pen comprises an elongated pen body and a point light source provided at a light end of the pen body for drying the nail polish on one single particular fingernail.

In another embodiment, the handheld nail care tool can be an electric nail file detachable coupled at the station housing for manicuring, pedicuring, shaping, polishing, removing callus, etc.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
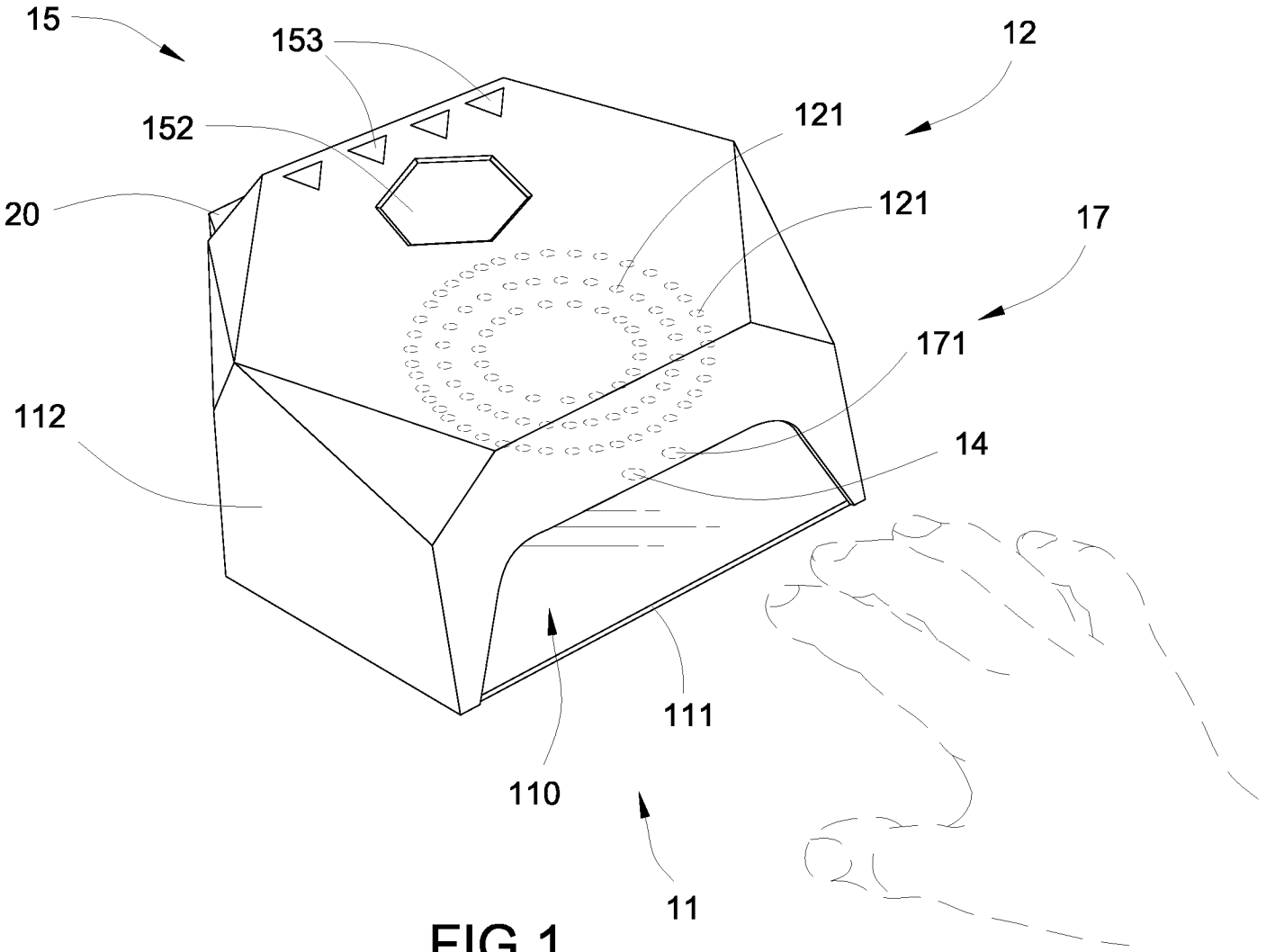
FIG. 1 is a front perspective view of a 2-in-1 nail lamp station according to a preferred embodiment of the present invention.
Figure 2:
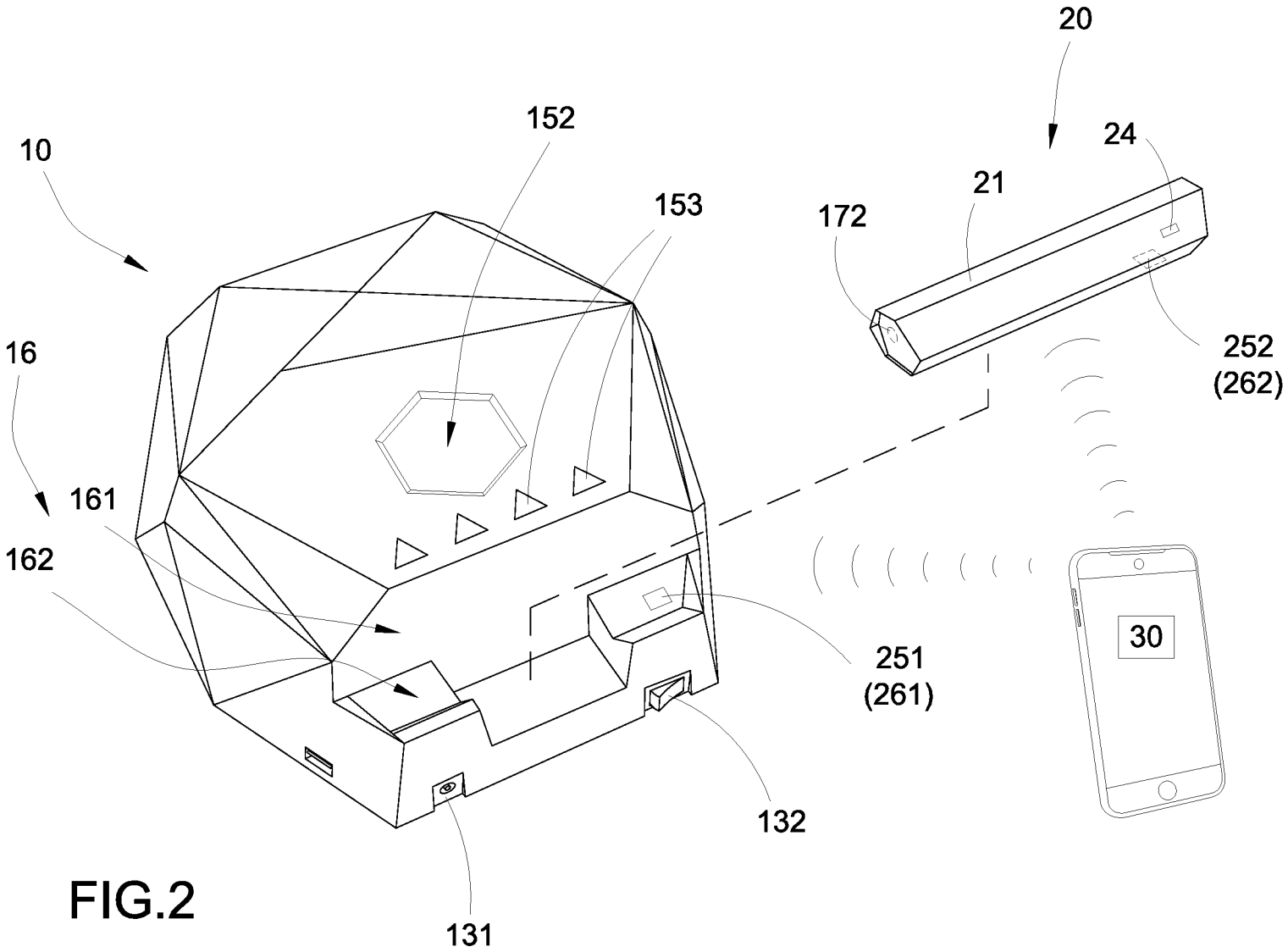
FIG. 2 is an exploded rear perspective view of the 2-in-1 nail lamp station according to the preferred embodiment of the present invention.
Figure 3:
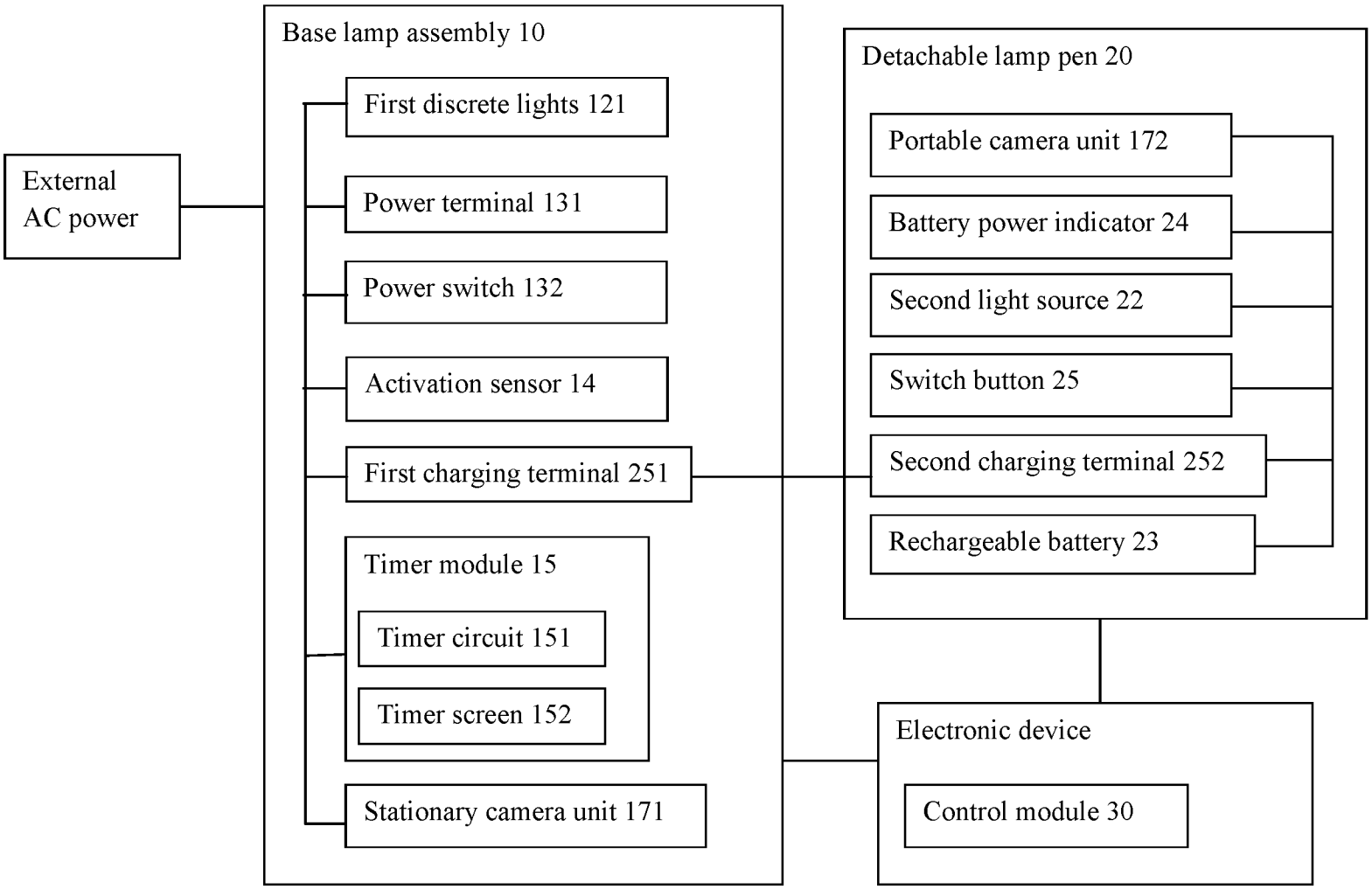
FIG. 3 is a block diagram of the 2-in-1 nail lamp station according to the preferred embodiment of the present invention.

Referring to FIGS. 1 to 3 of the drawings, a 2-in-1 nail lamp station according to a preferred embodiment of the present invention is illustrated, wherein the nail lamp station of the present invention is arranged for drying nail polish on a nail surface. Accordingly, the nail lamp station comprises a base lamp assembly 10 and a handheld nail care tool.

According to the preferred embodiment, the base lamp assembly 10 comprises a station housing 11 having a light cavity 110 capable of receiving multiple fingernails therewithin, and a main light source 12 supported within the light cavity 110 for drying nail polishes on the fingernails at the same time within the light cavity 110.

According to the preferred embodiment, the handheld nail care tool is a battery-powered tool for providing an additional nail care for the fingernail. In one embodiment, the handheld nail care tool is a detachable lamp pen 20.

The detachable lamp pen 20 is embodied as a single finger lamp. The detachable lamp pen 20 is detachably coupled at the station housing 11, wherein the detachable lamp pen 20 comprises an elongated pen body 21 and a point light source 22 provided at a light end of the pen body 21 for drying the nail polish on one single particular fingernail.

Accordingly, the station housing 11 comprises a base panel 111 and a top casing 112 upwardly extended therefrom to form the light cavity 110 with a front opening. In other words, the front opening is formed at a surrounding wall of the top casing 112 to communicate with the light cavity 110. The front opening is big enough for two or more fingernails inserting into the light cavity 110.

The main light source 12 comprises a plurality of first discrete lights 121 spacedly supported within the light cavity 110 for generating curable lights to dry the nail polishes on the fingernails within the light cavity 110. Particularly, the main light source 12 is supported at a ceiling of the light cavity 110 to emit the curable light downwardly. Furthermore, a bottom floor of the light cavity 110 is a mirror surface for reflecting the light from the main light source 12 within the light cavity 100. Preferably, the main light source 12 is a LED light source or a UV light source.

The base lamp assembly 10 further comprises a power terminal 131 electrically linked to the main light source 12 for electrically connecting to an external AC power, and a power switch 132 operatively linked to the main light source 12 to switch the main light source 12 in an on-and-off manner.

The base lamp assembly 10 further comprises an activation sensor 14 electrically lined to the main light source for automatically activating the main light source 12 when the activation sensor 14 detects a presence of the fingernail within the light cavity 110. Preferably, the activation sensor 14 is located adjacent to the front opening of the station housing 11, such that when the user inserts the fingernail into the light cavity 110 through the front opening, the main light source 12 will be automatically switched on via the activation sensor 14. Once the fingernail leaves the light cavity 110 from the front opening, the main light source 12 will be automatically switched off via the activation sensor 14. It is worth mentioning that the activation sensor 14 is activated for detecting the presence of the fingernail when the main light source 12 is switched on via the power switch 132.

Accordingly, the base lamp assembly 10 further comprises a timer module 15 which comprises a timer circuit 151 operatively linked to the main light source 12 for setting an activation time interval thereof, and a timer screen 152 provided on the station housing 11 for displaying the activation time interval. Preferably, a plurality of timer setters 153 are provided on the station housing 11 as a time interval input to set the time interval. For example, the user sets 30 seconds as the activation time interval, wherein when the activation sensor 14 detects a presence of the fingernail within the light cavity 110 to switch on the main light source 12, the main light source 12 will be automatically switched off after 30 seconds of the activation time interval.

According to the preferred embodiment, the detachable lamp pen 20 is detachably coupled at a rear top side of the station housing 11. A shown in FIG. 2, the station housing 11 further has a holding compartment 16 formed thereon at a position opposite to the light cavity 110, such that the pen body 21 is retained at the holding compartment 16 of the station housing 11. Particularly, the holding compartment 16 is formed at the rear top side of the top casing 112 of the station housing 11.

As shown in FIG. 2, the holding compartment 16, having a L-shaped cross section, is formed at the rear top side of the top casing 112 of the station housing 11, such that the holding compartment 16 forms an open slot configuration to receive the detachable lamp pen 20. With the open slot configuration, the user is able to easily place and/or remove the detachable lamp pen 20 at the holding compartment 16. The holding compartment 16 has an upright aligning side 161 and a horizontal resting side 162, such that the pen body is guided and supported via the aligning side 161 and the resting side 162 of the holding compartment 16 respectively. Preferably, the pen body 21 of the detachable lamp pen 20 has a non-circular cross section that two circumferential non-circumferential sides thereof are correspondingly biased against the aligning side 161 and the resting side 162 of the holding compartment 16 respectively.

According to the preferred embodiment, the detachable lamp pen 20 further comprises a rechargeable battery 23 supported within the pen body 21 to electrically connect with the point light source 22, and a battery power indicator 24 provided at the pen body 21 to electrically link to the rechargeable battery 23 for indicating an electrical level thereof. Therefore, when the battery power indicator 24 indicates the low battery power of the rechargeable battery 23, the user should recharge the rechargeable battery 23 before the detachable lamp pen 20 is operated.

When the rechargeable battery 23 is charged, the user is able to switch on the point light source 22 to emit the curable light for operation. In other words, the user is able to operate the detachable lamp pen 20 in a cable free manner. In order to charge the rechargeable battery 23, the detachable lamp pen 20 further comprises a first charging terminal 251 provided at the station housing 11 to electrically link to the external AC power, and a second charging terminal 252 provided at the pen body 21 to electrically link to the rechargeable battery 23. When the second terminal 252 is electrically contacted with the first terminal 251, the rechargeable battery 23 is automatically charged. It is worth mentioning that the power switch 132 should be switched on to charge the rechargeable battery 23. In other words, when the power switch 132 is switched off, the rechargeable battery 23 will not be charged even the second terminal 252 is electrically contacted with the first terminal 251.

As shown in FIG. 2, the first charging terminal 251 is provided at the holding compartment 16, such that the rechargeable battery 23 is charged when the pen body 21 is retained at the holding compartment 16 of the station housing 11. In particular, the first charging terminal 251 is provided on the resting side 162 of the holding compartment 16 and the second charging terminal 252 is provided on the circumferential side of the pen body 21, such that when the pen body 21 is rested on the resting side of the holding compartment 16, the second terminal 252 is electrically contacted with the first terminal 251 to charge the rechargeable battery 23.

According to the preferred embodiment, the rechargeable battery 23 also forms a power supply for the main light source 12 when the pen body 21 is retained at the holding compartment 16 of the station housing 11 and when the power terminal 131 is electrically disconnected with the external AC power. In case the user cannot find any external AC power to connect the base lamp assembly 10, the main light source 12 and the point light source 22 can be powered by the rechargeable battery 23 via the electrically contact between the first and second charging terminals 251, 252. In other words, the main light source 12 can be powered on when the detachable lamp pen 20 is received at the holding compartment 16 of the base lamp assembly 10. The point light source 22 can be powered on when the detachable lamp pen 20 is detached from the holding compartment 16 of the base lamp assembly 10.

Furthermore, the detachable lamp pen 20 further comprises a first magnetic member 261 provided at the station housing 11 and a second magnetic member 262 provided at the pen body 21 to magnetically attract to the first magnetic member 26 so as to automatically align the second charging terminal 252 with the first charging terminal 251. Preferably, the first and second charging terminals 251, 252 are contacted with each other via magnetic engagement that the first and second charging terminals 251, 252 are two magnetic members respectively. In other words, the first and second magnetic members 261, 262 are integrated with the first and second charging terminals 251, 252.

Figure 4:
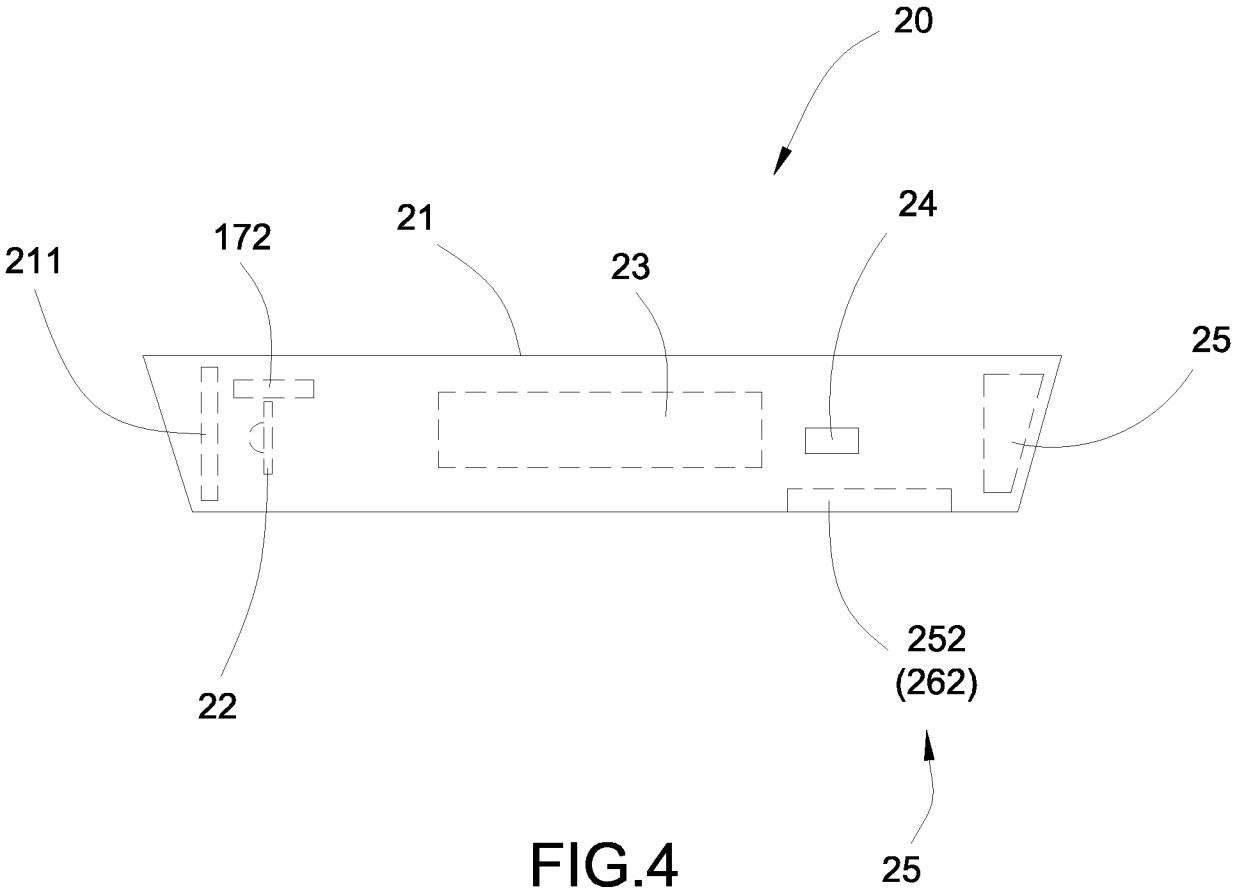
FIG. 4 is a side view of a detachable lamp pen of the 2-in-1 nail lamp station according to the preferred embodiment of the present invention.

As shown in FIG. 4, the pen body 21 has an elongated structure and has a polygonal cross section to enable the user to hold the pen body 21 ergonomically. The pen body 21 further has a light window 211 formed at the light end of the pen body 21 to align with the point light source 22.

Accordingly, the point light source 22 is a single light point for generating a focused curable light from the light end of the pen body 21. Likewise, the point light source 22 can be a LED light source or a UV light source. Therefore, the point light source 22 of the detachable lamp pen 20 is able to generate the focused light to pin-point a drying area on the nail surface. In other words, the user is able to easily operate the detachable lamp pen 20 by simply pointing the light end of the pen body 21 of the detachable lamp pen 20 toward the nail surface.

As shown in FIG. 3, the pen body 20 further has a switch end opposed to the light end thereof, wherein a switch button 25 is provided at the switch end of the pen body 20 to selectively control the point light source 22 in an on-and-off manner. Preferably, the light end and the switch end of the pen body 20 are two slanted surfaces. Therefore, the user is able to ergonomically hold the pen body 21 at an angle with respect to the nail surface to project the curable light from the point light source 22 to the particular area on the nail surface through the light window 211.

Accordingly, the user is able to detach the detachable lamp pen 20 from the base lamp assembly 10. With the mobility design of the detachable lamp pen 20, the user is able operate the detachable lamp pen 20 in a cable free manner in order to pre-cure the nail polish on the fingernail. Especially for the irregular or different sculptures on the nail surface, the light from the detachable lamp pen 20 can be pin pointed on a particular area of the nail surface to pre-cure the nail polish. Then, the user is able to insert the fingernail into the light cavity 110 to fully cure the nail polish.

The base lamp assembly 10 further comprises a camera module 17 for capturing nail images. The camera module 17 comprises a stationary camera unit 171 provided at the station housing 11 and electrically connected to the power terminal 131. Preferably, the stationary camera unit 171 is supported within the light cavity 110 for capturing the nail images when the user inserts the fingernail into the light cavity 110 through the front opening to dry the nail polishes. In one embodiment, video will be taken by the stationary camera unit 171 that video clips are recorded, such that the user is able to view the video clips. Preferably, the video clips can be uploaded to a server, such that the user is able to access the server to view the video clips. Accordingly, the to stationary camera unit 171 is operatively linked to the power terminal 131, wherein the stationary camera unit 171 is able to capture the nail images to determine the nail drying condition of the nail polish. Once the nail polish is dried via the analysis of the nail images, the main light source 12 will be automatically switched off.

In addition, the camera module 17 further comprises a portable camera unit 172 provided at the light end of the pen body 21 and electrically connected to the rechargeable battery 23 for capturing the nail images when simply pointing the light end of the pen body 21 of the detachable lamp pen 20 toward the nail surface. Likewise, video will be taken by the portable camera unit 172 that video clips are recorded, such that the user is able to view the video clips. It is worth mentioning that each of the stationary camera unit 171 and the portable camera unit 172 can be a clinical photography device for analyzing nail health. Once the nail images are captured, the user is able to view the nail images anytime to view the nail condition. A program can be provided in the server to analyze the nail images to determine the health condition of the nail, such as nail pitting, nail clubbing, spoon nails, and the like. In other words, the detachable lamp pen 20 also forms a portable nail analyzing device for determining the nail condition of the user. A nail condition result will be provided for the user to review after the nail treatment and/or a real-time user technical support information and guiding information will be provided to the user.

The 2-in-1 nail station of the present invention further comprises a control module 30 operatively linked to the base lamp assembly 10 and the handheld nail care tool. Accordingly, the control module 30 is wirelessly linked to the base lamp assembly 10 and the detachable lamp pen 20 to collect operation data thereof. The operation data, such as usage time, duration time, user identity, battery power, and other related information, of the base lamp assembly 10 and the detachable lamp pen 20 will be wirelessly sent to the control module 30. In one embodiment, the control module 30 can be an application or software adapted to be downloaded and installed into a user electronic device, such as computer or smart phone. The control module 30 can be wirelessly connected to the base lamp assembly 10 and the detachable lamp pen 20 through a wireless connection such as "Bluetooth", "Wi-Fi", "4G", 5G", or the like. For example, when the activation sensor 14 is activated to switch on and off the main light source 12, the activation signal of the main light source 12 as one of the operation data will wirelessly send to the control module 30. The time interval of the timer module 15, as another operation data, will also wirelessly send to the control module 30. The on-off signal of the detachable lamp pen 20 will wirelessly send to the control module 30. After the operation data is wirelessly sent to the control module 30, the operation data will be saved and a usage report will be generated by the control module 30 to the user. The user is able to login the control module 30, via the electronic device, to view the information of the base lamp assembly 10 and the detachable lamp pen 20.

It is worth mentioning that the control module 30 is wirelessly linked to the camera module 17, wherein the nail images from the stationary camera unit 171 and the portable camera unit 172 will wirelessly send to the control module 30 and will be saved in the electronic device. Therefore, the nail condition result, and/or a real-time user technical support information and guiding information will be provided to the user via the electronic device.

Figure 5:
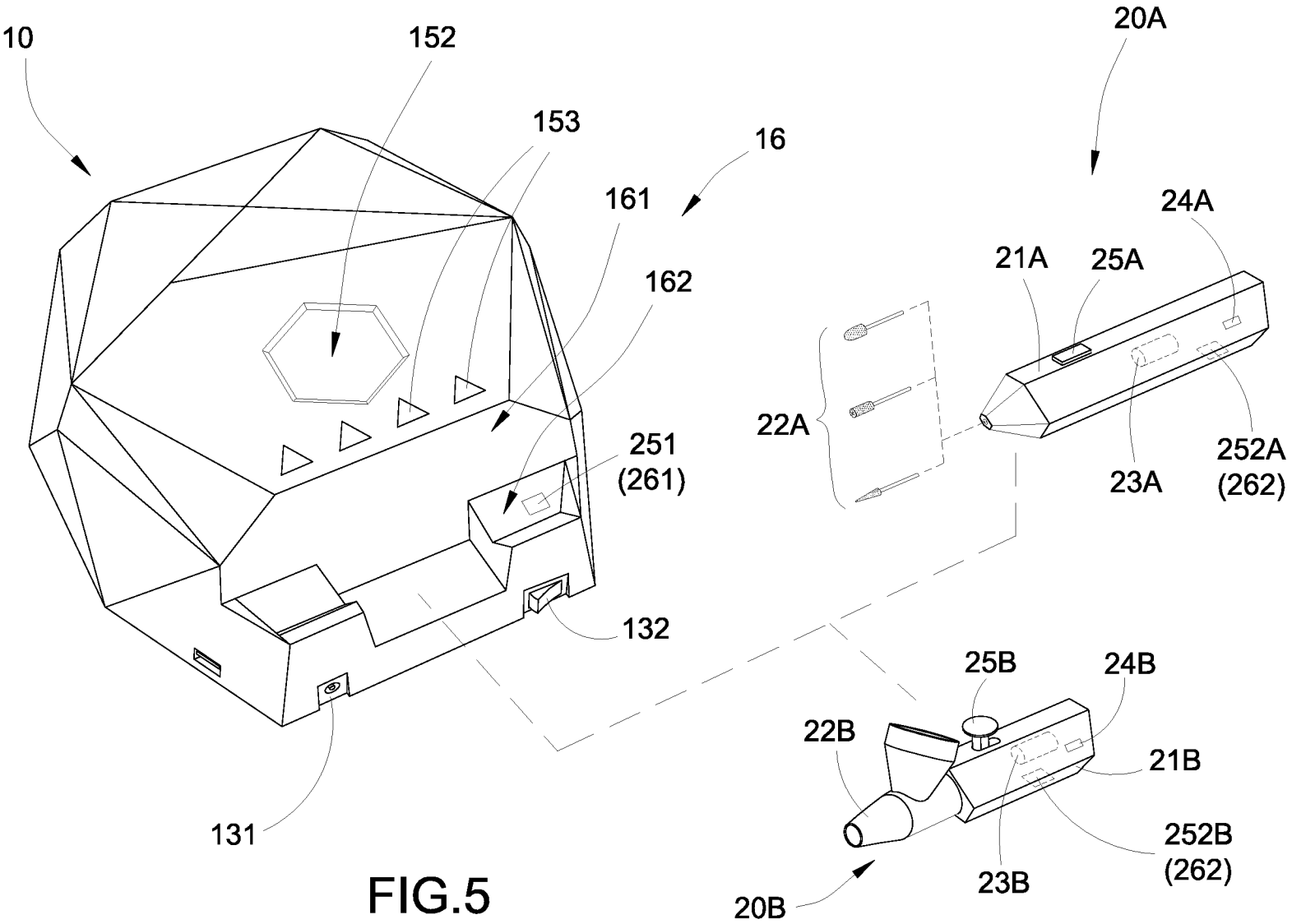
FIG. 5 illustrates an alternative mode of the handheld nail care tool of the 2-in-1 nail lamp station according to the preferred embodiment of the present invention.

FIG. 5 illustrates an alternative mode of the handheld nail care tool which is embodied as an electric nail file 20A detachably coupled at the station housing 11, wherein the electric nail file 20A comprises an elongated pen body 21A and a file head 22A provided at an end of the pen body 21A for nail surface treatment. The electric nail file 20A further comprises a rechargeable battery 23A, a battery power indicator 24A, a second charging terminal 252A electrically contacting with the first charging terminal 251 to charge the rechargeable battery 23A, and a switch button 25A to switch on and off the file head 22A. Accordingly, the file head 22A is a motor-powered file head electrically connected to the rechargeable battery 23A, wherein the file head 22A comprises a plurality of detachable head units detachably coupled to the end of the pen body 21A for manicuring, pedicuring, shaping, polishing, removing callus, etc. The detachable head units can be a nail drill bit and/or different nylon wheels.

Furthermore, the handheld nail care tool can be as an electric airbrush applicator 20B detachably coupled at the station housing 11, wherein the electric airbrush applicator 20B comprises an elongated pen body 21A and an airbrush head 22B provided at an end of the pen body 21B for applying a nail polish on the nail surface. The electric airbrush applicator 20B further comprises a rechargeable battery 23B, a battery power indicator 24B, a second charging terminal 252B electrically contacting with the first charging terminal 251 to charge the rechargeable battery 23B, and a switch button 25B to switch on and off the airbrush head 22B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A nail lamp station for drying nail polishes on fingernails of a hand of a user, comprising:

a base lamp assembly which comprises:

a station housing, which comprises a base panel and a top casing having a surrounding wall upwardly extended from said base panel to form said station housing having a light cavity, wherein said station housing has a front side, a rear side and a front opening which is formed at said surrounding wall of said top casing to communicate with said light cavity from said front side and has a size enough for two or more of the fingernails of the hand of the user being inserted into said light cavity, a holding compartment having an elongated opened slot configuration formed on top of said top casing of said station housing and positioned at a position opposite to said light cavity, and a main light source comprising a plurality of first discrete lights supported at a ceiling of said light cavity for generating curable lights downwardly drying the nail polishes on the fingernails of the hand of the user inserted within said light cavity; and a handheld nail care tool detachably coupled at said station housing for providing an additional nail care function, wherein said handheld nail care tool has an elongated pen body configured to be detachably retained at said opened slot configuration of said holding compartment of the station housing in such a manner for placing and removing said handheld nail care tool at said holding compartment;

wherein said handheld nail care tool comprises a detachable lamp pen detachably coupled at said holding compartment of said station housing, wherein said detachable lamp pen comprises an elongated pen body detachably retained at said holding compartment and a point light source provided at a light end of said pen body for generating a focused curable light from said light end to pin-point a drying area on a drying surface of the nail polish on one single particular fingernail of the user for drying the drying surface of the nail polish on the single particular fingernail of the user;

wherein said holding compartment, having a L-shaped cross section, is formed at a rear top side of said top casing of said station housing for placing and removing said detachable lamp pen at said holding compartment easily while said front opening communicating with said light cavity is formed at a bottom portion of said front side of said station housing, wherein said holding compartment has an upright aligning side and a horizontal resting side, such that said pen body is guided and supported via said aligning side and said resting side of said holding compartment respectively, wherein said pen body of said detachable lamp pen has a non-circular cross section that two non-circumferential sides thereof are correspondingly biased against said aligning side and said resting side of said holding compartment respectively.

2. The nail lamp station of claim 1, wherein said holding compartment, which forms an open slot configuration, has an upright aligning side and a horizontal resting side, such that said pen body is guided and supported via said aligning side and said resting side of said holding compartment respectively.

3. The nail lamp station of claim 2, wherein said first charging terminal provided on said resting side of said holding compartment.

4. A nail lamp station, comprising:

a base lamp assembly which comprises a station housing having a light cavity capable of receiving multiple fingernails therewithin, and a main light source supported within said light cavity for drying nail polishes on the fingernails at the same time within said light cavity; and a handheld nail care tool detachably coupled at said station housing for providing an additional nail care function;

wherein the handheld nail care tool comprises a detachable lamp pen detachably coupled at said station housing, wherein said detachable lamp pen comprises an elongated pen body and a point light source provided at a light end of said pen body for drying the nail polish on one single particular fingernail;

wherein the detachable lamp pen is accessible along the entire length of the lamp pen by a user;

wherein said station housing further has a holding compartment formed thereon at a position opposite to said light cavity, such that said handheld nail care tool is retained at said holding compartment of the station housing.

5. The nail lamp station of claim 4, wherein said handheld nail care tool comprises a detachable lamp pen detachably coupled at said station housing, wherein said detachable lamp pen comprises an elongated pen body detachably retained at said holding compartment and a point light source provided at a light end of said pen body for drying the nail polish on one single particular fingernail.

6. The nail lamp station of claim 4, wherein said base lamp assembly further comprises a power terminal electrically linked to said main light source for electrically connecting to an external AC power, wherein said detachable lamp pen further comprises a rechargeable battery supported within said pen body to electrically connect with said point light source.

7. The nail lamp station of claim 5, wherein said base lamp assembly further comprises a power terminal electrically linked to said main light source for electrically connecting to an external AC power, wherein said detachable lamp pen further comprises a rechargeable battery supported within said pen body to electrically connect with said point light source.

8. The nail lamp station of claim 7, wherein said detachable lamp pen further comprises a battery power indicator provided at said pen body to electrically link to said rechargeable battery for indicating an electrical level thereof.

9. The nail lamp station of claim 7, wherein said detachable lamp pen further comprises a first charging terminal provided at said station housing to electrically link to the external AC power, and a second charging terminal provided at said pen body to electrically link to said rechargeable battery and arranged in such a manner that when said pen body is retained at said holding compartment of the station housing, said second charging terminal is electrically connected with said first charging terminal to charge said rechargeable battery.

10. The nail lamp station of claim 9, wherein said rechargeable battery forms a power supply for said main light source when said pen body is retained at said holding compartment of said station housing and when said power terminal is electrically disconnected with the external AC power.

11. The nail lamp station of claim 9, wherein said detachable lamp pen further comprises a first magnetic member provided at said station housing and a second magnetic member provided at said pen body to magnetically attract to said first magnetic member so as to automatically align said second charging terminal with said first charging terminal.

12. The nail lamp station of claim 10, wherein said detachable lamp pen further comprises a first magnetic member provided at said station housing and a second magnetic member provided at said pen body to magnetically attract to said first magnetic member so as to automatically align said second charging terminal with said first charging terminal.

13. The nail lamp station of claim 11, wherein said holding compartment, which forms an open slot configuration, has an upright aligning side and a horizontal resting side, such that said pen body is guided and supported via said aligning side and said resting side of said holding compartment respectively.

14. The nail lamp station of claim 5, wherein said detachable lamp pen further has a light window formed at said light end of said pen body to align with said point light source.

15. The nail lamp station of claim 5, wherein said point light source is a single light point for generating a focused light from said light end of said pen body.

16. The nail lamp station of claim 5, wherein said light end of said pen has a slanted surface.

17. The nail lamp station of claim 5, wherein said pen body further comprises a switch end opposed to said light end thereof to selectively control said point light source in an on-and-off manner.

18. The nail lamp station of claim 4, wherein said base lamp assembly further comprises an activation sensor electrically lined to said main light source for automatically activating said main light source when said activation sensor detects a presence of the fingernail within the light cavity.

19. The nail lamp station of claim 5, wherein said station housing comprises a base panel and a top casing upwardly extended therefrom to form said light cavity with a front opening, wherein said detachable lamp pen detachably coupled at a rear top side of said top casing.

20. The nail lamp station of claim 4, wherein said main light source is provided at a ceiling of said light cavity while a bottom floor of said light cavity is a mirror surface for reflecting light from said main light source within said light cavity.

21. The nail lamp station of claim 4, wherein said base lamp assembly further comprises a timer module which comprises a timer circuit operatively linked to said main light source for setting an activation time interval thereof, and a timer screen provided on said station housing for displaying said activation time interval.

22. The nail lamp station of claim 4, wherein said hand-held nail care tool comprises a detachable lamp pen detachably coupled at said station housing, wherein said detachable lamp pen comprises an elongated pen body and a portable camera unit provided at a light end of said pen body for capturing nail images.

23. The nail lamp station of claim 22, wherein said detachable lamp pen further comprises a rechargeable battery supported within said pen body to electrically connect with said portable camera unit.

24. The nail lamp station of claim 4, wherein said base lamp assembly further comprises a stationary camera unit provided at said station housing for capturing nail images.

25. The nail lamp station of claim 4, wherein said hand-held nail care tool comprises an electric nail file detachably coupled at said station housing, wherein said electric nail file comprises an elongated pen body and a file head provided at an end of said pen body for nail surface treatment.

26. The nail lamp station of claim 25, wherein said file head comprises a plurality of detachable head units detachably coupled to said end of said pen body.

27. The nail lamp station of claim 25, wherein said electric nail file further comprises a rechargeable battery supported within said pen body to electrically connect with said file head.

28. The nail lamp station of claim 4, wherein said hand-held nail care tool comprises an electric airbrush applicator detachably coupled at said station housing, wherein said electric airbrush applicator comprises an elongated pen body and an airbrush head provided at an end of said pen body for applying the nail polish on the nail surface.

29. The nail lamp station of claim 28, wherein said electric airbrush applicator further comprises a rechargeable battery supported within said pen body to electrically connect with said airbrush head.

* * * * *